United States Patent [19]

Mosesian

[11] Patent Number: 4,646,053

[45] Date of Patent: Feb. 24, 1987

[54] ELECTRIC FUSE HAVING WELDED FUSIBLE ELEMENTS

[75] Inventor: Jerry L. Mosesian, Newburyport, Mass.

[73] Assignee: Gould Inc., Rolling Meadows, Ill.

[21] Appl. No.: 814,561

[22] Filed: Dec. 30, 1985

[51] Int. Cl.[4] ..... H01H 85/16

[52] U.S. Cl. ..... 337/232; 337/246; 337/252; 337/278

[58] Field of Search ..... 337/231, 232, 246, 251, 337/252, 278

[56] References Cited

U.S. PATENT DOCUMENTS

| | | | |
|---|---|---|---|
| 3,460,086 | 8/1969 | Fister | 337/246 |
| 4,540,969 | 9/1985 | Sugar | 337/232 |
| 4,563,809 | 1/1986 | Reeder | 337/231 |

*Primary Examiner*—Harold Broome

*Attorney, Agent, or Firm*—Frederick A. Goettel, Jr.

[57] ABSTRACT

A fillerless electric fuse having a tubular casing with open ends is provided with a fusible element in the form of an extremely fine wire extending from one of the open ends to the other. The casing is provided with a pair of annular sections of reduced diameter at opposite ends thereof which receive a pair of metal contact rings having an outside diameter substantially the same as the outside diameter of the fuse casing. The fusible element extends through each of the open ends of the casing and is welded into electrically conductive relationship with the axially outwardly facing surfaces of the respective metal contact rings. End terminals are press fitted over each of the metal contact rings and are permanently secured to the fuse casing. Means are provided inside the fuse to establish an impermeable barrier of insulating material within the fuse casing around the fusible element and between the end caps.

4 Claims, 5 Drawing Figures

ELECTRIC FUSE HAVING WELDED FUSIBLE ELEMENTS

BACKGROUND OF THE INVENTION

1. Field of the Invention

This invention relates to electric fuses of relatively small dimension which are used to interrupt relatively small currents in relatively high voltage circuits.

2. Description of the Prior Art.

Of the many metals and metallic alloys available, a relatively small number possess the requisite properties which make them satisfactory for fabricating the fusible elements to be used in electric fuses of the type used to protect electric circuits. The number becomes even smaller as materials are considered which may be used as the fusible element in fuses of relatively small dimension which are used to interrupt relatively small currents in relatively high voltage circuits. In such applications where the amperages of the fuses are small, the fusible elements are usually made from extremely fine wire-like materials having very small cross sectional areas.

Such extremely fine wire-like elements are so small and fragile that a number of problems are encountered in designing and manufacturing such fuses that are not typically found in the design and manufacture of most electrical fuses. For example, it is customary to fill the casings of such electrical fuses with a granular arc-quenching filler material. However, where the amperages of such fuses are small, the cross sectional area of the fusible elements of the fuses are so small that it is difficult to obtain uniform heat transfer from the fusible elements to the surrounding arc-quenching filler material. For example, if the arc-quenching filler material is a granular material such as quartz sand, there will be minute voids between the grains of the arc-quenching material and the fusible elements, the voids having a lower heat transferring capability than the grains of sand. On the other hand, if the arc-quenching material is a granular material having a finer grain, such as gypsum, the forces which must be used to compact the arc-quenching filler material within the casings of the fuses can displace the fusible elements from their intended positions within the casings, and may even break the fusible elements. Further, even if a fine grain arc-quenching material such as gypsum, could be compacted around the fusible element without breaking the element, the arc-quenching material could develop cracks or voids when the fuse was handled, such cracks or voids having a lower heat transfer capability than the body of filler material.

Furthermore, regardless of whether a large or fine grain arc-quenching filler material is used, the filling of such small fuse casings is an extremely tedious and delicate operation and the vibration and other handling of the fuse associated with achieving a good void-free fill could often result in breakage of the extremely fine wire-like elements in such low amperage fuses.

Consequently, it is desirable to provide low amperage electric fuses which are capable of protecting relatively high voltage circuits which may be provided with extremely short casings, wire-like elements, and that are devoid of granular arc-quenching filler material. One such electric fuse design is disclosed in U.S. Pat. No. 3,460,086 entitled PROTECTORS FOR ELECTRIC CIRCUITS to A. J. Fister.

SUMMARY OF THE INVENTION

When building such a fuse without an arc-quenching filler material within the casing, it has been found desirable to select a material that has a specific heat capacity which is relatively low compared to other materials in order to minimize the thermal energy within the fuse casing and the resulting pressure within the casing in the form of gasses which are generated upon vaporization of the fusible element under short circuit conditions. Materials having a relatively low specific heat capacity include gold, silver, lead, cadmium and tungsten.

Of these, very fine wire sections of gold would be extremely costly and extremely soft and fragile and therefore unsuitable for use as a fusible element in a massproduced commercial fuse. Lead and cadmium, while not as costly as gold, are also extremely soft and would break readily in such fine wire-like sizes. Further, because of their low melting points both exhibit numerous problems, in such sizes, when attempting to solder or weld them. Such problems include melting of the wire, necking down of the wire and solder flowing down the wire.

Silver, again is relatively expensive and fragile in such small sizes although satisfactory results have been obtained in fuse amperages greater than 4/10 amps. With smaller sizes of silver, however, many of the above mentioned manufacturing problems encountered with soldering extremely fine wires are encountered. Such problems have resulted in great difficulty in maintaining uniformity of the resistance in the finished product, a serious drawback.

According to the present invention, extremely fine wire-like tungsten fusible elements have been found to possess not only an extremely low specific heat capacity but also to be extremely strong and capable of withstanding the handling necessary during the manufacture of such an electric fuse. Further, tungsten wire also may be readily welded without a high risk of damage to the wire during the welding operation.

The present invention accordingly provides for a low amperage electric fuse capable of protecting relatively high voltage circuits which may be provided with extremely short casings, extremely fine, wire-like fusible elements, and that are devoid of granular arc-quenching filler material. The fuse structure comprises a relatively simple design making use of fusible elements made from materials having relatively low specific heat values yet which lend themselves to manufacturing techniques including welding of the fine wire elments which eliminate many of the manufacturability problems experienced in prior design fuses using such extremely fine wire-like elements.

More specifically, according to the present invention, an electric fuse is provided which has a tubular casing having open ends and a fusible element in the form of an extremely fine wire extending from one of the open ends to the other. The tubular casing is provided with a pair of annular sections of reduced diameter at opposite ends thereof which receive a pair of metal contact rings having an outside diameter substantially the same as the outside diameter of the fuse casing. The fusible element extends through each of the open ends of the casing and is welded into electrically conductive relationship with the axially outwardly facing surfaces of the respective metal contact rings. A pair of end terminals or caps are press fitted over the outside of each of the metal contact rings and are crimped to the casing to permanently secure and close each of the ends of the fuse casing. Means are provided inside the fuse casing to intimately surround a portion of the length of the fusible element and to establish intimate contact with the inside wall of the fuse casing to establish a substantially impermeable barrier of insulating material within the fuse casing between the respective terminal caps.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiments when read in connection with the accompanying drawings wherein like numbers have been employed in the different figures to denote the same parts and wherein:

DESCRIPTION OF THE PREFERRED EMBODIMENTS

Figure 1:
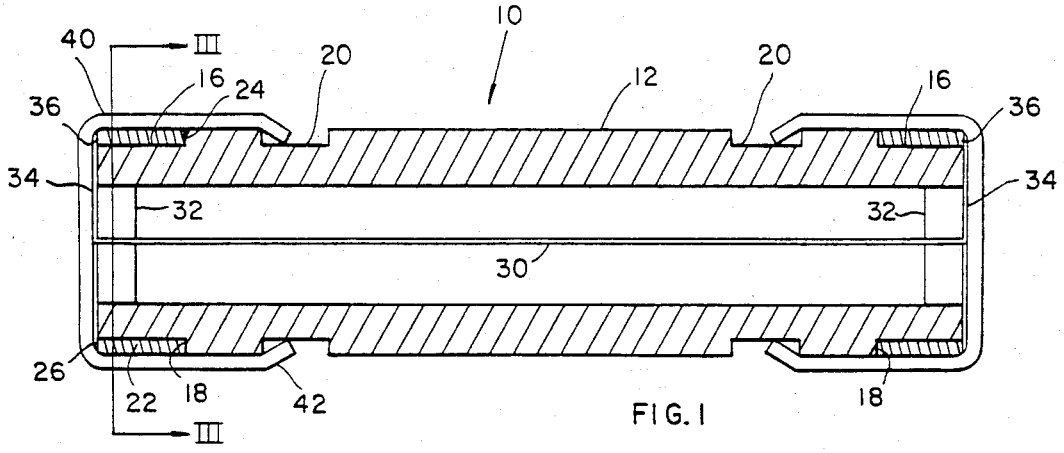
FIG. 1 is a longitudinal section through one preferred embodiment of an electric fuse that is made in accordance with the principles and teachings of the present invention.

Referring now to the drawings in detail, reference numeral 10 generally refers to an electric fuse made according to the present invention. The fuse 10 includes an outer cylindrical casing or tube 12 having a predetermined outer diameter and a predetermined inner diameter and open ends. The casing 12 is made from a suitable insulating material such as, for instance, a synthetic resin glass-cloth laminate. Each end of the fuse casing 12 is provided with an open ended annular groove 14. Each of the grooves 14 are defined by an open ended section 16 having a diameter reduced from that of the predetermined diameter of the casing. Each of the grooves 14 further includes an annular shoulder 18 which faces towards the axial open ends of the casing 12 and which define the transition to the outside diameter of the fuse casing 12. A second annular groove 20 is provided at each end of the fuse casing and is spaced axially inwardly from each of the open ended grooves 14. Each of the sets of annular grooves 14, 20 may be formed in the fuse casing by a machining operation and each is made shallow relative to the thickness of the casing wall so that they will not unduly weaken the casing 12.

Figure 3:
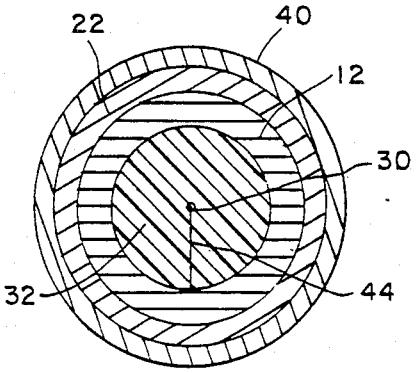
FIG. 3 is an enlarged sectional view of the fuse of FIG. 1 taken along the line III—III thereof.
Figure 4:
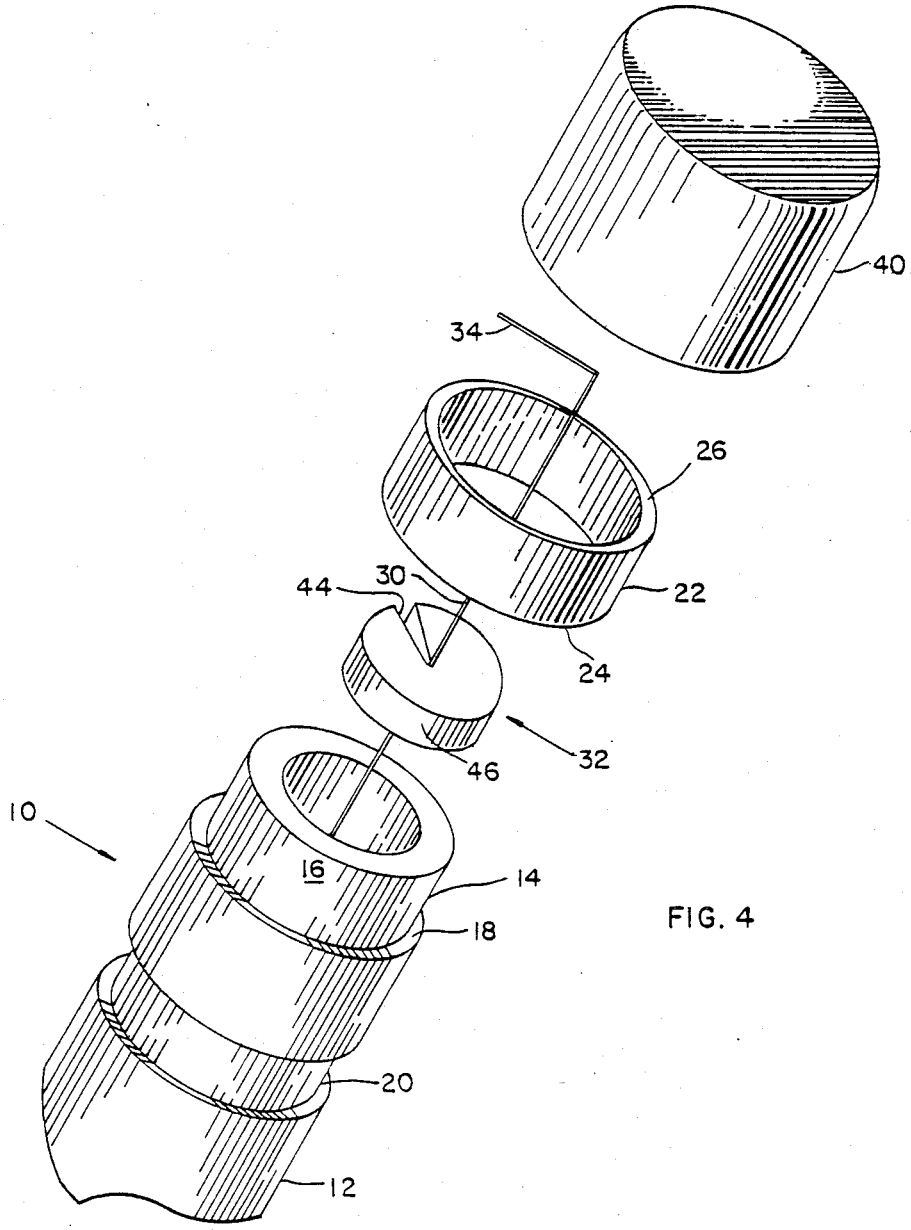
FIG. 4 is an exploded isometric view of one end of the fuse of FIG. 1.
Figure 5:
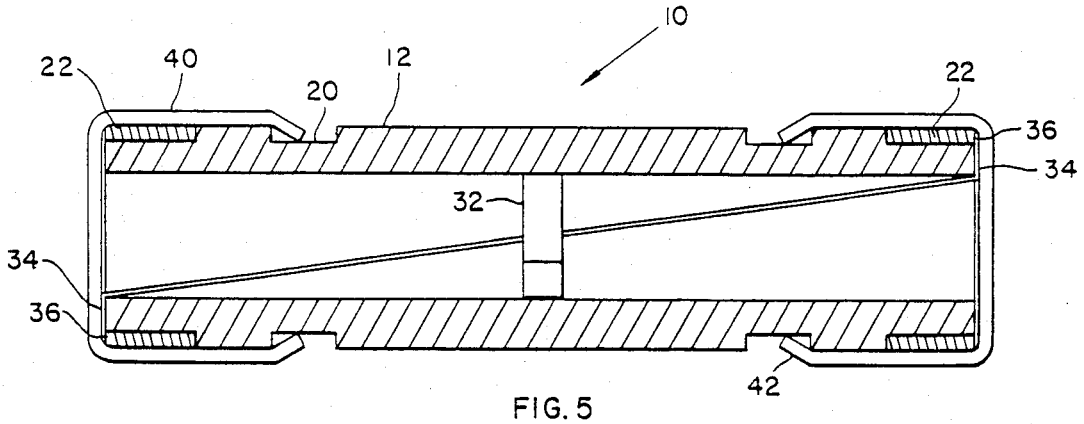
FIG. 5 is a longitudinal section of another preferred embodiment of an elecric fuse according to the present invention.

With particular reference now to FIGS. 1, 3 and 4. Reference numeral 22 denotes a metal contact ring or element one of which is press fit onto each of the ends of the fuse casing into the open ended annular grooves 14. Each of the metal contact rings 22 has an outside diameter which is substantially the same as the predetermined outside diameter of the fuse casing 12. The inside diameter of each of the metal contact rings 22 is substantially the same as that of the annular sections of reduced diameter 16 associated with each of the open ended grooves 14. Such relationship allows the rings 22 to be readily press fit onto the annular sections of reduced diameter 16. When in such press fit relationship, as shown in FIG. 1 and 5, a first axial end 24 of each of the rings 22 engages the annular shoulder 18 of the section of reduced diameter 16 with which the contact ring is associated. The second axial end 26 of each of the metal contact rings 22 lies in a substantially coplanar relationship with the open end of the fuse casing 12 with which the ring 22 is associated.

Reference numeral 30 denotes an elongated, small-diameter, wire-like fusible element which extends the full length of the fuse casing 12 from one open end thereof to the other. At each end of the casing 12, the fusible element 30 passes through a cylindrical barrier 32 of insulating material which is disposed within the inside of each of the open ends of the casing 12. The physical characteristics of the cylindrical barrier of insulating material 32 and the manner in which this barrier engages the fusible element 30 and the inside wall of the casing 12 will be described in more detail hereinbelow following the completion of the description of the overall structural details of the fuse 10.

The ends 34 of the wire-like fusible element 30 which extend beyond the open ends of the fuse casing 12 are bent at a substantially 90° angle with respect to the longitudinal axis of the fuse and are positioned into engagement with the axial end 26 of the metal contact rings 22 which are substantially coextensive with the axial open ends of the fuse casing 12. Each of the ends 34 are then welded to the axial ends 26 of the contact rings 22 as indicated by the reference numeral 36. Such welding may be accomplished by well-known electrical resistance welding techniques with the welding current being suitably selected to achieve a good electrically conductive connection between the fusible element and the axial end of the contact ring without destroying or weakening the fragile wire-like fusible element. The attachment of the fusible element to the axial end of the metal contact rings, it should be evident, is identical at each end of the fuse of the present invention.

In a preferred embodiment, fuses have been manufactured where the metal contact rings 22 are made from brass. In such applications, fusible elements 30 made from tungsten wire having diameters from 0.0005–0.0026 inch have been used to make fuses having amperage ratings from 1/10 to ¾ of an amp. Fusible elements 30 made from silver wire having diameters from 0.001–0.00375 inch have been used to make fuses having amperage ratings between 4/10 to 1½ amps. The welding apparatus used in manufacturing such fuses includes a first electrode partially encircling a contact ring 22 and a second electrode comprised of a tungsten tip press fit into a copper rod which engages the end 34 of the wire element. The welding surface of the tip is tapered to about 0.040 inch. A working pressure of 9 to 10 pounds has been found to provide good results for all wire diameters used.

Reference numeral 40 has been applied to indicate a pair of terminal caps, preferably of a non-ferrous material such as copper or brass and plated with a good electrically conductive material such as silver or tin. The terminal caps 40 have an inside diameter such that they must be mounted under pressure, i.e. they must be press fitted over the outside diameter of the metal contact rings 22 and over a portion of the outside diameter of the fuse casing 12. The terminal caps 40 extend axially along the length of the casing 12 such that the free ends of the terminals 42 may be rolled or crimped into the annular grooves 20 to thereby permanently secure the terminal caps 40 to the fuse casing 12.

The construction of the fuse 10 as described hereinabove may be further appreciated with reference to the other Drawing Figures wherein various components of the fuse are shown at different points in the assembly of such a fuse. With reference now to all of these Figures, the cylindrical barriers 32 of insulating material are made from a material such that when the fusible element 30 is passed through an opening in the material and the barrier is press fit into the interior of the fuse casing 12 the barrier establish an impermeable barrier within the fuse casing between the respective terminal caps 40 of the fuse. In the embodiment shown in FIG. 1, each of the illustrated cylindrical barriers 32 serves to establish such an impermeable relationship with respect to the terminal caps 40 thus assuring extremely high reliability in preventing the arc plasma from extending between and from "feeding" on the end terminals 40 upon melting of the fusible element. Such a barrier is established according to the present invention without subjecting the extremely fragile wire-like fusible elements 30 to potentially damaging paths during construction of the fuse.

The barrier of insulating material 32 is preferably fabricated from a material which is rigid yet deformable and which is capable of withstanding the elevated temperatures to which such an electric fuse may be subjected during normal fuse use. A preferred material is polytetra fluoro-ethylene (PTFE), commonly known by the trade name Teflon, sold by E. I. duPont deNemours. Other fluorocarbon polymers and polyamide polymers possessing properties similar to Teflon may be used satisfactorily in practicing the present invention.

Figure 2:
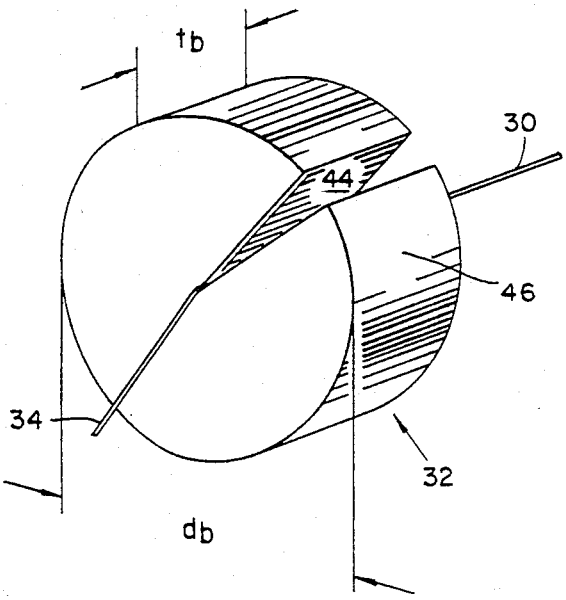
FIG. 2 is an enlarged perspective view of an insulating barrier as used in the fuse of FIG. 1 with the fusible element threaded therethrough prior to insertion in a fuse casing.

Referring now to FIGS. 2 and 4, the thickness $t_b$ of the barrier 32 is selected such that when the barrier is press fit into the interior of the fuse casing 12, as shown in FIG. 1, it has sufficient thickness relative to its diameter $d_b$ to permit it to be retained in a perpendicular relationship with respect to the longitudinal axis of the tubular casing 12. It has been found that, when the thickness of the barrier $t_b$ is preferably equal to or greater than one-third of the diameter $d_b$ of the barrier 32, the desired perpendicular relationship of the barrier 32 within the casing 12 is reliably maintained.

Referring still to FIGS. 2 and 4, it will be noted that in both of these figures, the insulating barrier 32 is shown with a pie or wedge-shaped opening 44 therein. Such opening 44 is caused by cutting a radial slot in the Teflon barrier extending from the outer periphery thereof through the geometric center and slightly beyond. The Teflon material advantageously opens up to form the wedge-shaped opening 44 shown in FIGS. 2 and 4 when such a slot is cut. The wedge-shaped opening 44 facilitates threading of the fusible element 30 through the barrier 32 to a location substantially near the center thereof.

Construction of a fuse 10 such as that illustrated in FIG. 1 accordingly is carried out by first threading the fusible element 30 through the fuse casing 12 with a portion thereof extending beyond both open ends. A first insulating barrier 32 may then be readily engaged with the fusible element 30 as shown in FIGS. 2 and 4 and the barrier 32 press-fit into one open end of the fuse casing 12. The fusible element 30 may then be drawn taut through the other end of the fuse. The other insulating barrier 32 may then be positioned as shown in FIGS. 2 and 4, and similarly press fit into the other open end of the fuse casing. The ends 32 of the fusible element 30 are then welded to the outwardly facing ends 26 of their respective metal contact ring 22 and the terminal caps 40 installed as described above.

The outer diameter $d_b$ of each of the insulating barriers 32 is selected with respect to the inside diameter of the tubular casing 12 such that when the insulating barriers 32 are press fit into the open ends of the casing in the desired perpendicular relationship with the casing the barrier is compressed. Such compression of the barriers 32 result in the outside perimeter 46 of the barrier being in intimate sealing contact with respect to the inner wall of the fuse casing 12. Such compression of the barrier 32 is sufficient to close the slot 44 in the insulating barrier 32 into intimate conforming contact with the wire-like fusible element 30. This relationship is shown in FIG. 3 of the drawings. Such relationship of the insulating barrier 32 establishes the desired impermeable barrier within the fuse casing 12 thereby preventing arc plasma from extending between the terminal caps 40 of the fuse when the fusible element 30 melts.

When assembled as described above, the wire-like fusible element 30 is supported in a fixed position within the fuse casing with a substantial portion of the length of the fusible element equally spaced from the inner walls of the casing. In the described embodiment, such support is provided by the Teflon insulating barriers 32, however, other support means such as the barrier structure disclosed in previously discussed U.S. Pat. No. 3,460,086 may be substituted therefor.

As mentioned hereinabove, each of the Teflon insulating barriers 32 establishes an impermeable barrier within the fuse casing sufficient to allow the fuse to perform reliably upon melting of the fusible element. FIG. 5 illustrates an embodiment wherein a single cylindrical barrier 32 of Teflon is positioned within a fuse casing 12 at a substantially central location thereof. In this embodiment, the structure of the fuse is substantially identical to that described hereinabove with respect to FIGS. 1 through 4, however, the welded attachments of the ends 34 of the fusible element 30 to the ends 26 of the metal contact rings 22 are positioned at locations diametrically (180°) opposite from one another such that the fusible element 30 extends diagonally through the interior of the fuse casing 12 thereby resulting in positioning the fusible element within the fuse casing 12 spaced from the interior walls of the casing along substantially the entire length of the fusible element.

It will be thus be appreciated that the above-described fuse design provides for a low amperage electric fuse capable of protecting relatively high voltage circuits which may be provided with short casings, extremely fine, wire-like fusible elements and that have no granular arc-quenching filler material within the casing. The fuse structure comprises a relatively simple design making use of fusible elements made from materials having low specific heat value which lend themselves to manufacturing techniques including welding of the fine wire elements which eliminate many of the manufacturability problems experienced in prior design fuses using such extremely fine wire-like elements.

This invention may be practiced or embodied in still other ways without departing from the spirit or essential character thereof. The preferred embodiments described herein are therefor illustrative and not restrictive, the scope of the invention being indicated by the appended claims and all variations which come within the meaning of the claims are intended to be embedded therein.

What is claimed is:

1. An electric fuse which comprises:

a. a tubular casing of insulating material having a predetermined outside diameter and open ends, said casing including a pair of annular sections of reduced diameter, one of said annular sections being immediately adjacent each of said open ends, the transition between said outside diameter of said casing and each of said sections of reduced diameter defining an annular shoulder which is substantially perpendicular to the longitudinal axis of said casing, each of said shoulders facing in the direction of its respective open end;

b. a pair of metal contact rings each having an outside diameter substantially the same as the outside diameter of said casing and an inside diameter substantially the same as said annular sections of reduced diameter, one of said rings being press fit onto each of said annular sections of reduced diameter, a first axial end of each of said rings engaging the annular shoulder of its respective section of reduced diameter, and a second axial end of each of said rings being substantially coplanar with one of said open ends of said casing;

c. a fusible element in the form of a wire extending from one open end of said casing to the other end thereof, one end of said wire being bent into engagement with and welded into electrically conductive relationship with the second axial end of one of said rings, and the other end of said wire being bent around and welded into electrically conductive relationship with the second axial end of the other of said rings, said welded connections being substantially diametrically opposed from one another, whereby a substantial portion of the length of said fusible element is spaced from the inner wall of said casing;

d. a pair of terminal caps each having an inside diameter substantially the same as the outside diameter of said metal contact rings, one of said caps being permanently secured to and closing each of the ends of said casing, said caps extending along the fuse casing axially beyond said annular shoulders; and e. means for establishing a substantially impermeable barrier of insulating material within said fuse casing between the respective terminal caps.

2. The electric fuse of claim 1 wherein said pair of metal contact rings are made from brass and wherein said fusible element is made from a metal selected from the group consisting of silver and tungsten.

3. An electric fuse which comprises:

a. a tubular casing of insulating material having a predetermined outside diameter and open ends, said casing including a pair of annular sections of reduced diameter, one of said annular sections being immediately adjacent each of said open ends, the transition between said outside diameter of said casing and each of said sections of reduced diameter defining an annular shoulder which is substantially perpendicular to the longitudinal axis of said casing, each of said shoulders facing in the direction of its respective open end;

b. a pair of metal contact rings each having an outside diameter substantially the same as the outside diameter of said casing and an inside diameter substantially the same as said annular sections of reduced diameter, one of said rings being press fit onto each of said annular sections of reduced diameter, a first axial end of each of said rings engaging the annular shoulder of its respective section of reduced diameter, and a second axial end of each of said rings being substantially coplanar with one of said open ends of said casing;

c. a fusible element in the form of a wire extending from one open end of said casing to the other end thereof, one end of said wire being bent into engagement with an welded into electrically conductive relationship with the second axial end of one of said rings, and the other end of said wire being bent around and welded into electrically conductive relationship with the second axial end of the other of said rings;

d. a pair of terminal caps each having an inside diameter substantially the same as the outside diameter of said metal contact rings, one of said caps being permanently secured to and closing each of the ends of said casing, said caps extending along the fuse casing axially beyond said annular shoulders; and e. means for engaging and supporting said fusible element in a fixed position within said casing with a substantial portion of the length of said fusible element equally spaced from the inner wall of said casing, said means for engaging and supporting also establishing a substantially impermeable barrier of insulating material within said fuse casing between the respective terminal caps.

4. The electric fuse of claim 3 wherein said pair of metal contact rings are made from brass and wherein said fusible element is made from a metal selected from the group consisting of silver and tungsten.

* * * * *